United States Patent [19]

Chou

[11] Patent Number: 4,896,684

[45] Date of Patent: Jan. 30, 1990

[54] BI-DIRECTIONAL NAIL TRIMMER

[76] Inventor: Fargo Chou, P.O. Box 10160, Taipei, Taiwan

[21] Appl. No.: 331,745

[22] Filed: Apr. 3, 1989

[51] Int. Cl.[4] ..... A45D 29/05

[52] U.S. Cl. ..... 132/73.6; 132/75.6; 132/75.8; 132/76.4; 51/3; 51/170 R

[58] Field of Search ..... 132/73.6, 75.6, 75.8, 132/76.4; 51/3, 170 R

[56] References Cited

U.S. PATENT DOCUMENTS 2,056,379 10/1936 Acocella ..... 132/73.6
3,255,766 6/1966 Hartwell et al. ..... 132/73.6
3,311,117 3/1967 Thompson ..... 132/73.6
4,137,926 2/1979 Pao ..... 132/73.6

*Primary Examiner*—John J. Wilson
*Assistant Examiner*—Frank A. LaViola

[57] ABSTRACT

A nail trimmer includes a motor having a motor shaft having its one end mounted with a first cylindrical-rod polisher and having the other end of the shaft mounted with a second disk-shaped polisher, in which the motor can be shifted either rightwardly to protrude the first polisher for polygonally trimming a user's nail, or leftwardly to protrude the second polisher for planarly trimming the user's nail.

10 Claims, 2 Drawing Sheets

BI-DIRECTIONAL NAIL TRIMMER

BACKGROUND OF THE INVENTION

P. F. Acocella disclosed a manicuring implement in his U.S. Pat. No. 2,056,379 by mounting a file 19 and polisher 18 respectively on a shaft 15 driven by an electric motor. In operating such a conventional nail manicuring implement, a user's nail must be carefully poked into an opening 23 or 22 to be polished by file 19 or polisher 18.

Since the opening or window 23 or 22 is quite small, the user should hold this implement very carefully in order to allow the file or polisher within the opening to manicure the user's nail. Or, the user's finger should be carefully posed or moved with respect to the position and orientation of the opening and the file or polisher provided within the opening. The polishing area of the file or polisher as limited within the tiny opening is also too small to facilitate a nail manicuring operation. Meanwhile, the debris or scales of the polished nail may be centrifugally fed into a cavity in the handle 13 to accumulate dirts and bacteria inside the implement, causing a hygienic problem.

The present inventor has found the drawbacks of a conventional manicuring tool as above-mentioned and invented the present nail trimmer.

SUMMARY OF THE INVENTION

The object of the present invention is to provide a nail trimmer having a primary polisher generally made as a cylindrical rod mounted on a right side of a motor shaft for polygonally manicuring a user's nail and a secondary polisher generally made as a disc mounted on a left side of the motor shaft opposite to the primary polisher for planarly manicuring the user's nail, the motor shaft being shifted either leftwardly or rightwardly to protrude either polisher for manicuring the nail polygonally or planarly.

DETAILED DESCRIPTION

Figure 1:
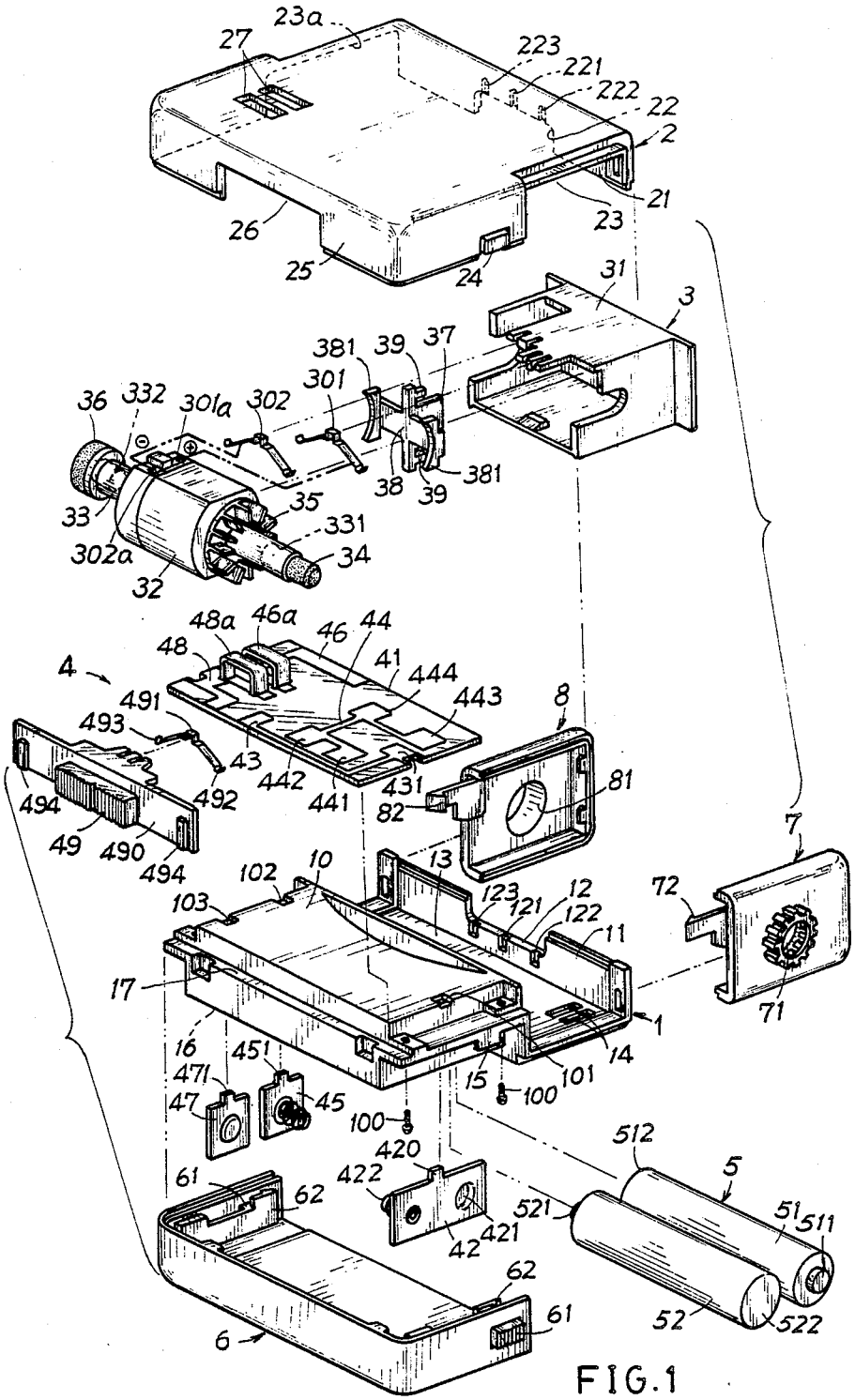
FIG. 1 is an illustration showing all elements in construction of the present invention.

As shown in the FIGS. 1–4, the present invention comprises: a basic body 1, an upper cover 2, a motor means 3, a switch means 4, a power source 5, a bottom cover 6, a first side door 7, and a second side door 8.

The basic body 1 includes: a front wall plate 11 having a lower recess 12 formed on a central portion of the front plate 11, a front groove 13 transversely formed across a width of the body 1 adjacent to the front plate 11, a pair of side lugs 15 formed on two opposite side portions of the body 1, a battery chamber 16 formed in a rear portion of the body 1 and a rear groove 17 transversely formed on a rear portion of the body 1 above the battery chamber 16. Several exhaust holes 14 are provided in the groove 13 for discharging air or dirts blown by a fan 35 of the motor means 3. Three lower notches 121, 122, 123 are transversely formed along an edge of the recess 12. Several fixing holes 101, 102, 103 are formed in an upper plate 10 above the battery chamber 16 for fixing electric connector clips which are described hereinafter. Plural screws 100 are provided to fix the upper cover 2 on the body 1.

Figure 2:
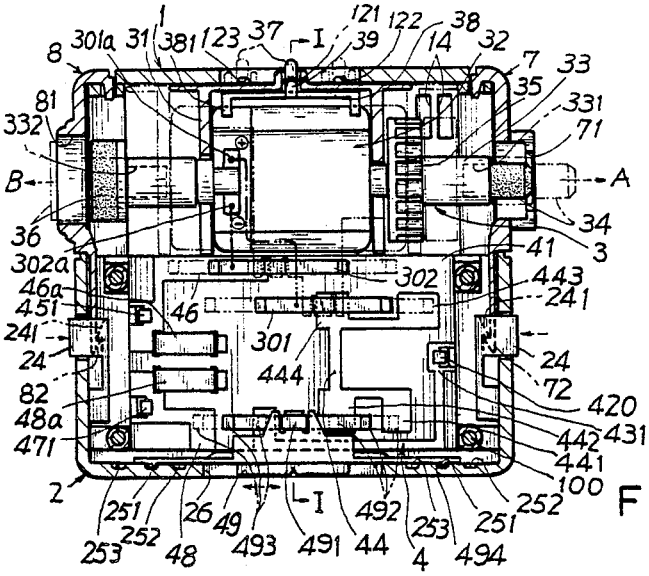
FIG. 2 is a top-view illustration of the present invention when removing an upper cover thereof.

The upper cover 2 includes: a front wall plate 21 having an upper recess 22 formed on a central portion of the front plate 21 for forming a front botton slot S in combination with the lower recess 12 of the basic body 1, a pair of side openings **23, 23*a* respectively formed on two opposite sides of the cover 2, two side buttons 24 resiliently formed on two opposite sides of the cover 2 each button 24 pertaining a hook end portion 241 formed inside the cover 2 as shown in FIG. 2, a rear wall plate 25 formed with a rear button slot 26, and two sockets 27 formed in an upper plate of the cover 2 adapted for connecting an alterative current for charging batteries 51, 52 of the power source 5. Three upper notches 221, 222, 223 are formed along an edge of the recess 22 each upper notch projectively aligned with each lower notch 121, 122, 123 formed on the lower recess 12**.

The motor means 3 includes: a frame 31 for securing a motor 32 in the frame slidably held in the front groove 13 of the basic body 1, a motor shaft 33 protruding laterally from two sides of the motor 32, a primary polisher 34 detachably mounted in a first socket 331 formed on a right side of the shaft 33, a fan 35 having fan blades radially formed on the shaft 33 between the motor 32 and the primary polisher 34, a secondary polisher 36 detachably mounted in a second socket 332 formed on a left side of the shaft 33 opposite to the first socket 331, a front button 37 protruding frontwardly through the front slot S from a spring plate 38 having a pair of brackets 381 formed on two end portions of the plate 38 frictionally retained between the motor 32 and the frame 31, two positioning keys 39 formed on the spring plate 38 engageable with each pair of an upper notch 221 or 222 or 223 and a lower notch 121 or 122 or 123, a positive spring contactor 301 mounted on the frame 31 and electrically connected with a positive pole **301*a* of the motor 32, and a negative spring contactor 302 mounted on the frame 31 and electrically connected with a negative pole 302*a* of the motor 32**.

The switch means 4 includes: an insulator plate 41 fixed on an upper plate 10 of the body 1, an intermediate clip 42 perpendicularly secured to a right side edge of the plate 41 by poking a lug 420 through a side hole 101 of the body 1 and disposed at a right side of the battery chamber 16, an intermediate flat contactor 43 formed on an upper surface of the insulator plate 41 electrically connected with the intermediate clip 42 and positioned at a rear portion of the plate 41, a double-U shaped flat contactor 44 formed on a right-side surface of the plate 41, a negative-pole clip 45 perpendicularly secured to a left side edge of the plate 41 opposite to the right side edge by poking a lug 451 through a side hole 102 of the body 1, a negative-pole flat contactor 46 formed on the upper surface of the plate 41 slidingly contacting the negative spring plate 302 of the motor means 3, a positive-pole clip 47 perpendicularly secured to a left side edge of the plate 41 neighboured to the negative-pole clip 45 by poking a lug 471 through a side hole 103 of the body 1, a positive-pole flat contactor 48 formed on the surface of plate 41, and a rear button 49 slidingly formed on a rear portion of the body 1.

The intermediate clip 42 has a positive-pole connector 421 for connecting a positive pole 511 of a first battery 51 of the power source 5 and a negative-pole connector 422 for connecting a negative pole 522 of a second battery 52 connected in series with the first battery 51. The lug 420 after poking through the hole 101 is crimped to secure the right side of the plate 41 on the body 1 to electrically contact an end portion 431 of the contactor 43. The lug 451 of the clip 45 is crimped to secure the left side of the plate 41 on the body 1 to electrically contact the contactor 46. A pair of terminals 46*a*, 48*a* are respectively connected with the negative-pole contactor 46 and the positive-pole contactor 48 and are positioned under the cover 2 corresponding to the two sockets 27 for charging the batteries 51, 52 by an external AC power.

The double-U shaped flat contactor 44 includes: a rear U-shaped contactor having two contacting spots 441, 442 for slidingly contacting a first contacting leg 492 of a spring contactor 491 secured to the rear button 49, and a front U-shaped contactor having two contacting spots 443, 444 for slidingly contacting a contacting leg of the positive spring contactor 301.

The clips 45, 47 are disposed on a left side of the battery chamber 18 wherein the battery 52 of power source 5 has its positive pole 521 contacted with the clip 47 and the battery 51 has its negative pole 512 contacted with the clip 45.

The rear button 49 protrudes outwardly through a rear button slot 26 of the cover 2 from a slide plate 490 slidably engageable with the rear groove 17 having a spring contactor 491 mounted on the plate 490. On two opposite ends of the plate 490, there are provided with two keys 494 each key slidably engageable with each of three notches 251, 252, 253 formed inside a rear wall plate 25 of the cover 2.

Figure 3:
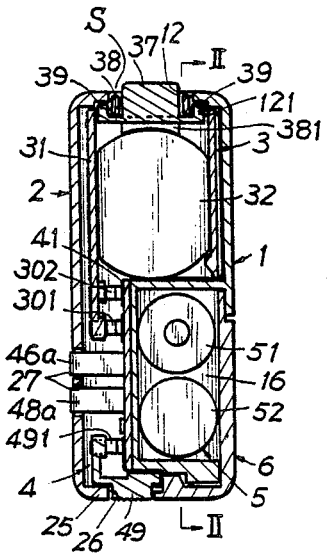
FIG. 3 is a side-view sectional drawing of the present invention when viewed from I—I direction of FIG. 2.
Figure 4:
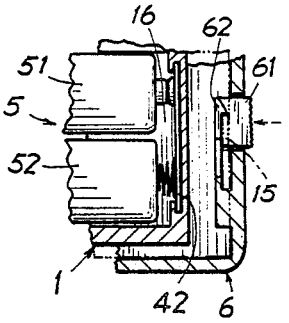
FIG. 4 is a partial sectional drawing of the present invention when viewed from II—II direction of FIG. 3.
Figure 5:
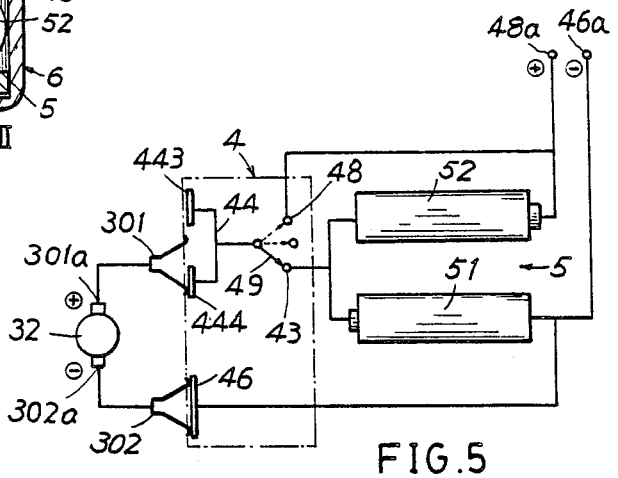
FIG. 5 is a circuit diagram of the present invention.

The bottom cover 6 includes two side buttons 61 each pertaining a hook end portion 62 engagable with each side lug 15 formed on the body 1 so that the bottom cover 6 can be secured to the body 1 by engaging each hook end portion 62 with each side lug 15 to cover the battery chamber 16 as shown in FIGS. 4 and 3.

The first side door 7 has a hook end portion 72 engageable with the other hook end portion 241 of a right side button 24 of the cover 2 so as to detachably shield a right side opening 23, and has a central hole 71 for protruding the primary polisher 34 outwardly as shown in dotted line of FIG. 2. The second side door 8 is formed with a central hole 81 for protruding the secondary polisher 36 outwardly in a direction opposite to the primary polisher 34, and has a hook end portion 82 engageable with another hook end portion 241 of a left side button 24 so as to detachably shield a left side opening 23*a*. The debris of the polished nail is sucked through hole 71 by the fan 35 and blown off through exhaust holes 14. The air blown through holes 14 may also dry a nail varnish or oil for further purpose.

When using the present invention, the front button 37 may be depressed to release the keys 39 from the central notch 221, 121 and pushed towards a right side of the cover 2 and body 1 as shown in direction A of FIG. 2 to protrude the primary polisher 34 outwardly and also start the motor running. The primary polisher 34 is formed as a cylindrical rod made of abrasive or polishing materials (such polishing materials being wellknown in the art and not claimed in this invention) for primarily manicuring a user's nail by optionally orienting the nail with the polygonal surfaces of the polisher 34.

Then the button 37 is depressed and pushed towards the left side of the cover 2 opposite to the right side as aforementioned to protrude the secondary polisher 36 outwardly in direction B as shown in FIG. 2 opposite to the direction A for further trimming the user's nail by contacting the nail with a larger plannar surface of the disk-shaped secondary polisher 36. The nail after being manicured by the primary polisher 34 may still have irregular corrugate shapes or acute angles formed on a nail contour, which may then be smoothly manicured by the larger disk-shaped polisher 36. During the reciprocative shifting of the button 37, the motor 32 and shaft 33 as retained with the frame 31 and button 37 may be slidingly moved either rigtwardly to engage the key 39 with the notch 222, 122 formed on a right side of the central notch 221, 121 to protrude the polisher 34 rightwardly. While the button 37 is shifted leftwardly to engage the key 39 with the left notch 223, 123, the motor and shaft 33 will be moved to protrude the polisher 36 leftwardly. During the sliding movement of the button 37 and motor 32, the two spring plates 301, 302 are always connected to power source 5 for continuously running the motor 32 until the button 37 is moved to a central off position whereby the positive spring contactor 302 is not contacted with the U-shaped contactor 443, 444, thereby being disconnected from the power source 5.

The rear button 49 may be moved rightwardly to contact the two legs 492, 493 of the spring contactor 491 respectively with the rear U-shaped contactor 441 and the intermediate contactor 43, so that the positive pole 511 of first battery 51 is connected through clip 42, contactor 43, spring contactor 491, U-shaped contactor 44, positive-pole contactor 301 towards the positive pole 301*a* of the motor 32 and while the negative pole 512 of battery 51 is connected with clip 45, contactor 46 and the negative-pole contactor 302 towards the negative pole 302*a* of motor 32, thereby forming an electric circuit to power the motor 32 for driving the shaft 33. Since the spring contactors 301, 302 are moved either rightwardly or leftwardly to contact the contactors 44, 46 of power source 5, the motor 32 is continuously running, regardless of a rightwardly protruding polisher 34 or a leftwardly protruding polisher 36.

The above-mentioned situation is only powered by a single battery 51 which may be a 1.5 volts dry cell. When depressing the rear button 49 leftwardly to contact the two legs 492, 493 with the contactors 43, 48, two batteries 52, 51 will be connected to power the motor, which may be 3 volts higher than the aforesaid 1.5 volt. Accordingly, the rear button 49 may serve to adjust the motor running either quickly when moved leftwardly or slowly when moved rightwardly.

The right notch 252 engaged with the key 494 may indicate a slow adjustment of motor running, while the left notch 253 indicates a quick adjustment. The central notch 251 will position the button 49 to be electrically "off" for replacing polishers 34, 36.

The side doors 7, 8 may be withdrawn for replacing new polishers 34, 36 or other trimming tools. The bottom cover 6 may be opened for replacing new batteries 51, 52.

Conclusively, the present invention can be selectively operated to protrude either a cylindrical-rod polisher 34 or a disk-shaped polisher 36 for manicuring an user's nail either polygonally or planarly, which is more convenient in trimming a nail than a conventional nail trimmer. Once a polisher 34 is protruded outwardly the other polisher 36 is still retracted in the body 1 for safely holding the tool. When the button 37 is kept at its central off position, both polishers 34, 36 are held in the body 1 for safety reason.

I claim:

1. A bi-directional nail trimmer comprising:

a basic body having a front groove transversely formed across a width of said basic body;

an upper cover secured on an upper side of said basic body;

a motor means slidably engageable with said front groove of said basic body having a motor shaft protruding rightwardly and leftwardly on two opposite sides of a motor;

a primary polisher detachably mounted on a right side portion of said motor shaft for polygonally manicuring an user's nail, a secondary polisher detachably mounted on a left side portion of said motor shaft for planarly manicuring a user's nail;

a switch means for controlling a running speed of said motor; and a power source powering said motor and controlled by said switch means; both said primary polisher and said secondary polisher normally retracted in said body and said upper cover, said motor means having a front botton protruding frontwardly beyond said upper cover and operatively moved either rightwardly to protrude said primary polisher for primarily manicuring a user's nail or moved leftwardly to protrude said secondary polisher for further trimming the user's nail.

2. A bi-directional nail trimmer according to claim 1, wherein said primary polisher is made as a cylindrical rod for polygonally trimming a user's nail.

3. A bi-directional nail trimmer according to claim 1, wherein said secondary polisher is made as a disk shape for planarly trimming a user's nail.

4. A bi-directional nail trimmer according to claim 1, whrein said motor shaft is radially mounted with fan blades of a fan for sucking any debris or dirt of a cut nail which debris is blown off outwardly through an exhaust hole formed is said body.

5. A bi-directional nail trimmer according to claim 1, wherein two side doors are further provided to shield two side openings formed on two opposite sides of said basic body and said upper cover, each side door formed with a central hole for portruding either said polisher outwardly.

6. A bi-directional nail trimmer according to claim 5, wherein each said side door is formed with a hook end portion engageable with another hook end portion formed on a side button resiliently formed on a side portion of said upper cover mounted on said basic body, each said side door being detachably mounted on said upper cover and said body, operatively shielding each said side opening confined between said upper cover and said front groove of said basic body.

7. A bi-directional nail trimmer according to claim 1, wherein said power source includes two batteries connected in series in a battery chamber formed in a bottom portion of said body.

8. A bi-directional nail trimmer according to claim 7, wherein said battery chamber is shielded by a bottom cover detachably secured to said basic body.

9. A bi-directional nail trimmer according to claim 1, wherein said switch means includes an insulator plate formed on an upper plate of said body and under said upper cover having a plurality of flat contactors formed on said insulator plate electrically connecting said power source and said motor as controlled by a rear button slidably held in a rear portion of said body selectively connecting either a single battery from two said batteries of the power source for a slow running of said motor, or connecting both said batteries for a quick running of said motor.

10. A bi-directional nail trimmer according to claim 9, wherein two spring contactors are slidingly contacted with said flat contactors formed on said insulator plate, said two spring contactors being secured to said motor means for powering said motor electrically connected with said power source.

* * * * *